US005647471A

United States Patent [19]

Ra

[11] Patent Number: 5,647,471

[45] Date of Patent: Jul. 15, 1997

[54] COIN OPERATED VENDING MACHINE COIN SAFE

[76] Inventor: Corky Ra, 1502 River La., Santa Ana, Calif. 92706

[21] Appl. No.: 642,697

[22] Filed: May 3, 1996

[51] Int. Cl.[6] ..... G07F 9/06

[52] U.S. Cl. ..... 194/350; 232/15

[58] Field of Search ..... 194/350; 232/15, 232/16; 221/154

[56] References Cited

U.S. PATENT DOCUMENTS

| | | | |
|---|---|---|---|
| 753,824 | 3/1904 | Caldwell . | |
| 929,568 | 7/1909 | Davis . | |
| 1,050,608 | 1/1913 | Brown . | |
| 1,316,492 | 9/1919 | Mason . | |
| 1,627,547 | 5/1927 | Antoine et al. . | |
| 2,759,632 | 8/1956 | Ussery et al. . | |
| 2,853,172 | 9/1958 | Angell . | |
| 3,390,753 | 7/1968 | Bolen et al. . | |
| 3,783,986 | 1/1974 | Bolen . | |
| 3,804,294 | 4/1974 | Householder | 221/154 |
| 4,544,081 | 10/1985 | Voegeli . | |
| 5,131,519 | 7/1992 | Ra | 194/350 |
| 5,467,858 | 11/1995 | Kovens | 194/350 |
| 5,507,378 | 4/1996 | Leone | 194/350 X |

FOREIGN PATENT DOCUMENTS

| | | | |
|---|---|---|---|
| 24861 | 11/1902 | United Kingdom | 194/350 |

*Primary Examiner*—F. J. Bartuska
*Attorney, Agent, or Firm*—M. Reid Russell

[57] ABSTRACT

A coin vending machine body liner and locking plate as a coin safe that is for original installation or retrofitting in a conventional coin operated vending machine where, with the deposit of an appropriate coin in a coin mechanism and turning of that coin mechanism handle, a measured volume of product, such as loose candy, nuts, or the like, will vend from a chute in a front face of the vending machine and onto a person's hand. The liner is formed from a plastic material for closely fitting into the machine body, is closed across its bottom end, and has its top end arranged to be covered over by a locking plate that is includes a lock for maintaining the locking plate secured across the liner top end. The combination of the liner, that is closed across its bottom end, and the locking plate, provides a coin safe for maintaining coins therein as have passed through the coin mechanism. The liner to further include an arrangement for maintaining the coins as are passed therein against their passing back out of the liner between a liner edge and a wall of an adjacent coin mechanism.

9 Claims, 6 Drawing Sheets

COIN OPERATED VENDING MACHINE COIN SAFE

BACKGROUND OF THE INVENTION

1. Field of the Invention

This invention relates to coin operated vending machines, and in particular, to vending machines where, by turning a handle, loose product, such as nuts, candy, gum balls, or the like, are dispensed and including a coin containing box or safe that can be locked to retain coins fed therein.

2. Prior Art

Coin operated vending machines that are operated to vend product, such as nuts or candy, gum balls, or the like, dispensed out of a chute are well known. Such machines are found in many locations as are trafficked by the general public. The overall design of such coin vending machines has essentially remained the same over a number of years except as to changes in materials as are used to construct the machine. With many coin operated vending machines now being constructed mostly of plastic. While overall design has essentially remained the same, some changes and improvements have been made to vending machine coin receiving and turning mechanisms, as measured from an early patent to Brown, U.S. Pat. No. 1,050,608 for a coin operated vending machine to a more recent patent to Bolen, U.S. Pat. No. 3,783,986. Also, arrangements for setting and controlling a volume of product dispensed with each handle turn, are shown, as for example, in a patent to Brown U.S. Pat. No. 1,050,608 and in patents to Antoine, U.S. Pat. No. 1,627,547, to Angell, U.S. Pat. No. 2,853,172, and in a recent patent to Voegeli, U.S. Pat. No. 4,544,081. Further, a U.S. Pat. No. 5,131,519 was recently issued to the inventor for a lock box arrangement for controlling access to a coin containing portion of a vending machine body. The present invention, that also provides a lock box arrangement, improves upon the earlier invention with an inclusion of a liner for both containing coins deposited into the machine, and to prohibit such collected coins from being shaken therefrom. The invention, by its construction, also facilitates emptying coins therefrom and precludes coins from "hanging up" therein.

The combination of the locking coin safe and the liner arrangement of the present invention is useful for new manufacture and as an addition to a number of currently marketed designs of coin operated vending machines. Unique from earlier machines, the present invention provides a liner that is maintained, under a locking plate fitted over the coin receiving portion of the vending machine body, and is arranged to prohibit coins from being shaken from the body. With, after unlocking of the locking plate off from the coin receiving portion, the liner of the invention to facilitate the contained coins being poured out therefrom, rapidly and reliably emptying a vending machine of coins as have been collected.

SUMMARY OF THE INVENTION

It is a principal object of the present invention to provide a liner for fitting into a lock safe or box of a coin containing body portion of a coin operated vending machine that is arranged to prohibit coins from being shaken or otherwise removed prior to the lock safe being opened therefrom, and to facilitate a pouring of collected coins opened from the open lock safe or box.

Another object of the present invention is to provide a combination of a liner arranged to be maintained within a lock safe or box that is suitable for installation as part of a new manufacture or for retrofitting to a conventional coin operated vending machine, and provides for protecting collected coins from being removed by unauthorized persons from the vending machine lock safe or box of a vending machine body, but allows for easily and reliably removing collected coins therefrom.

Another object of the present invention is to provide a liner for mounting in a coin safe or box that is suitable for installation in most currently available coin operated vending machines.

Another object of the present invention is to provide a liner for mounting in a vending machine lock safe or box that includes an arrangement for maintaining the liner inner integrity while allowing or providing for passing coins from a coin mechanism thereof into the liner.

Still another object of the present invention is to provide a combination of a coin safe or box locking mechanism with a liner for maintaining collected coins that will accommodate, but will not interfere with, a vending machine product display head end that is attached over the vending machine body.

Still another object of the present invention is to provide a combination of a coin safe or box locking mechanism with a liner that is easily and conveniently installed within a coin receiving portion of a body of a conventional coin operated vending machine and is formed to protect against coins deposited therein being shaken or otherwise removed from the coin safe or box prior to that coin safe or box being opened with a key.

The liner and associated structure of the invention is an improvement in a coin safe or box locking mechanism of an earlier invention of the inventor, of U.S. Pat. No. 5,131,519. Like the '519 patent, the present invention includes a locking plate arranged for fitting and locking over an open top of a vending machine body or base with a liner of the invention to fit snugly within that body, providing a smooth walled coin catchment area. A liner upper lip fits closely against, and essentially seals to, the undersurface of the locking plate to prevent coins from being shaken out or otherwise removed from the body prior to opening the lock plate with a key. Accordingly, the liner will maintain coins as have traveled through a slot or open area from through the liner into the liner interior.

The liner is formed to fit within the vending machine body to provide flat smooth surfaces that extend upwardly, with a right angle slot or slots are formed in the body top edge and wherein a lip or lips of the locking plate is fitted. So arranged, the liner provides a smooth surface that coins will slide on when they are poured from the vending machine body. The combination of the liner and components thereof of the invention along with the locking plate are suitable for initial manufacture or for retrofitting to a conventional vending machine body coin box portion.

The liner of the invention is preferably formed of a semi-rigid material, such as plastic, to fit snugly into the body, filling the interior thereof. The locking plate preferably includes a coin box lock that is key operated so as to turn a cylinder that mounts a tight angle bar that turns into a second slot that is formed through the liner and into the body inner wall, adjacent to the top thereof. Operation of the lock provides for securing the locking plate to the liner top edge, covering over the vending machine body open top as the coin safe or box.

In practice, a person servicing a vending machine that incorporates the present invention can remove and fill the vending machine head or product containing portion and replace the coin filled vending machine body with an empty body. With the liner of the invention contained in the vending machine body to prohibit that operator from shaking coins or otherwise removing coins out of the body. The coin filled vending machine body is opened by the key holder who unlocks the locking plate and removes it. Whereafter, the body can be turned over, the contained coins sliding freely along the liner interior and out of the body to be caught in a coin holding vessel, such as a pail or bucket.

DESCRIPTION OF THE DRAWINGS

In the drawings that illustrate that which is presently regarded as the best mode for carrying out the invention.

DETAILED DESCRIPTION

Figure 1:
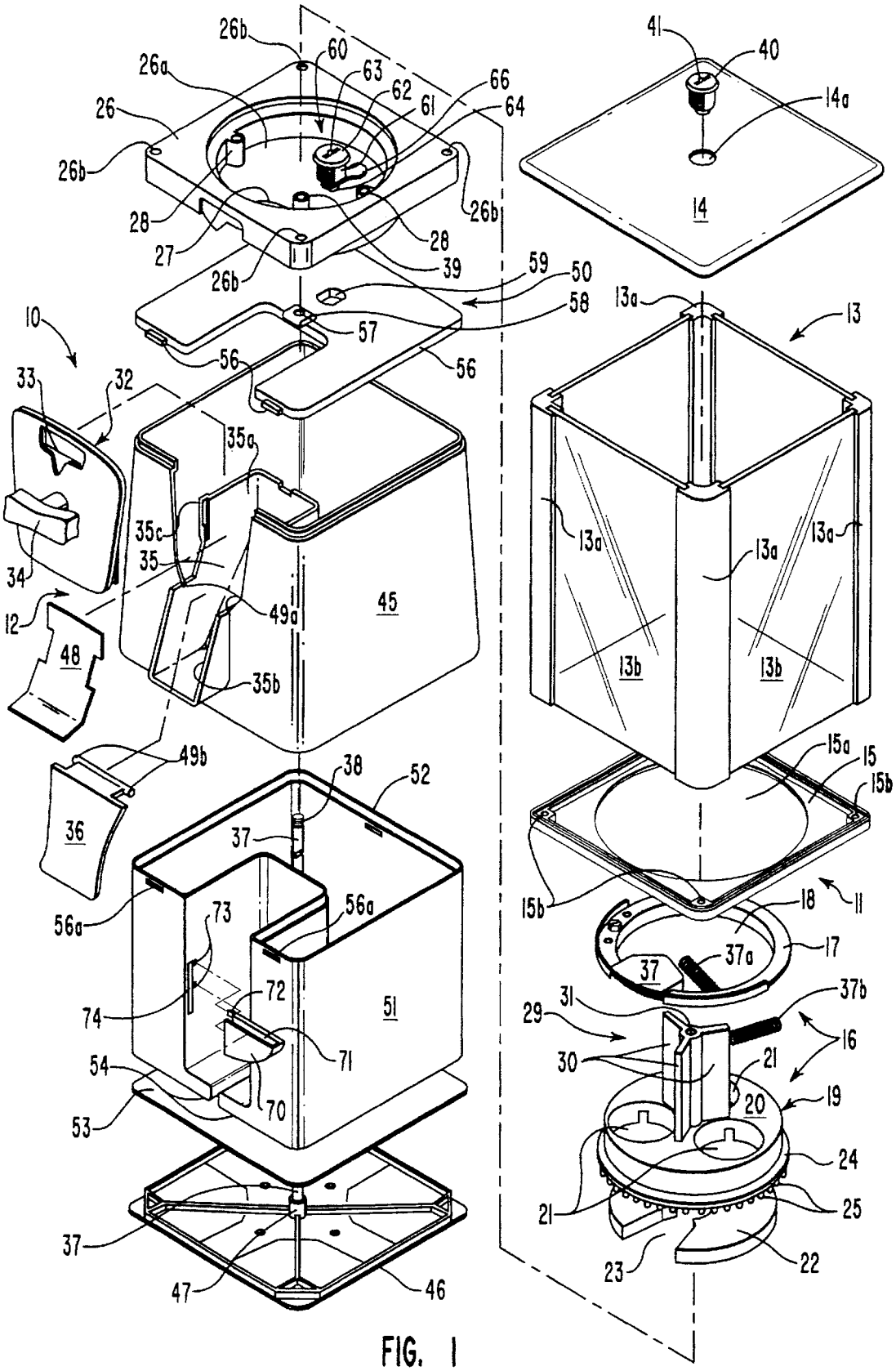
FIG. 1 is an exploded perspective view of a coin operated vending machine that includes an upper product containing head, coin operated product vending apparatus, and a lower body wherein is arranged a coin safe or box that is covered over by locking plate and includes a liner or the invention for mounting in the body.

FIG. 1 shows an exploded perspective view of a coin operated vending machine 10 of the invention, hereinafter referred to as vending machine. The vending machine 10 is conveniently separated into a head portion 11, that is to be filled with a bulk product, and mounts onto a body portion 12. Such bulk product, may consist of loose nuts or candy, or the like, and is displayed through a transparent globe 13, that is maintained between the cap 14 and hopper bottom 15. The hopper bottom 15 includes a center opening 15*a* wherein a brush wheel 16 is positioned to turn that includes a housing capsule 17 for fitting through center hole 18 to expose a top surface 20 of a wheel capsule 19 wherein spaced cups 21 are formed. The brush wheel 16 further includes, as a bottom thereof, a riser capsule 22, that incorporates a radial pie shaped slot 23. The wheel capsule 19 has a lower edge 24 that includes projections 25 extending downwardly at spaced intervals from therearound, with the riser capsule 22 for seating between the projections. The brush wheel 16 riser capsule 22 is maintained to posts 28 that are located above a bottom plate 26 and are secured at spaced intervals around an edge of the junction with the bottom plate 26*a* of hopper 26. A hole 27 is formed therethrough that the product is dispensed through. The wheel capsule 19 is turned by operation of a coin operated vending mechanism 32, as set out below. The wheel capsule 19 incorporates a center dispensing section wherein are radially arranged, cups 21 that are formed as arcuate depressions. The wheel capsule 19 includes a center upright stirring post 29 that has parallel stirring paddles that project at equal radial intervals from around a center axle hole 31. The stirring post 29 turns as the wheel capsule 19 is turned by operation of a coin operated vending mechanism 32, that is a component of the body portion 12, as described herein below.

When a coin is fitted into a slot 33 of the coin operated vending mechanism 32, and a handle 34 thereof is turned, a dog, bar or the like, of that turning mechanism, not shown, will engage a section of projections 25 to turn the wheel capsule 19. One of cups 21 is thereby moved into alignment with the pie shaped slot 23, allowing product in that cup to fall through the slot and hopper hole 27, and into a chute 35. Product falling through the chute 35 is maintained behind a pivot mounted chute cover 36, that is lifted to vend the product into a person's palm held below the chute bottom end. A volume control arrangement, shown as a block 37 that extends radially inwardly from the inner edge of the housing capsule 17, is provided that a cup 21 will travel under as it comes into alignment with the pie shaped slot 23. The block 37 edge is in the path of wheel capsule 19 turning to scrape excess product off the top of cup 21, controlling the volume of product as is delivered with each vend. The wheel capsule 19 is journaled to turn between the housing capsule 17 and the riser capsule 22, and is biased by springs 37*a* and 37*b* such that, after turning to align a cup 21 with the pie shaped where slot 23, wherethrough product is dispensed, the springs 37*a* and 37*b* act to return the wheel capsule 19 to the attitude shown in FIG. 1. Which attitude shows the wheel capsule 19 area between cups 21 positioned over the slot 23, blocking passage of product from the transparent globe 13 therethrough.

To assemble the hopper or head portion 11 screws, not shown, are fitted through corner holes 26*b* of the hopper 26, through holes 15*b* of the aligned hopper bottom 15 and into tapped holes formed into the bottom ends of each of the vertical comer supports 13*a*. Between which corner supports 13*a*, transparent panels 13*b* of the transparent globe 13 are maintained. The head portion 11 is assembled and fitted to the bottom portion 12 by fitting a rod 37, that has a threaded top end 38 as shown in FIG. 1, through a center holes formed through a sleeve 39 that extends at a right angle upwardly from the center of the hopper bottom plate 26*a*, and through the axial hole 31 of the stirring post 29. The rod 37 is fitted longitudinally through transparent globe 13, to pass out through a center hole 14*a* formed through the top plate 14. A locking sleeve 40 is provided for turning over the rod 37 threaded end 38 to maintain the top portion 11 to the bottom portion 12. The locking sleeve preferably includes a key hole 41 wherein a key is to be fitted for turning to allow the locking sleeve 40 to be turned onto and off of the threaded end 38. To add product only to the vending machine 10, the top plate 14 can be removed, as by turning of the locking sleeve 40, and product poured through the open top of the top portion 11.

Figure 2:
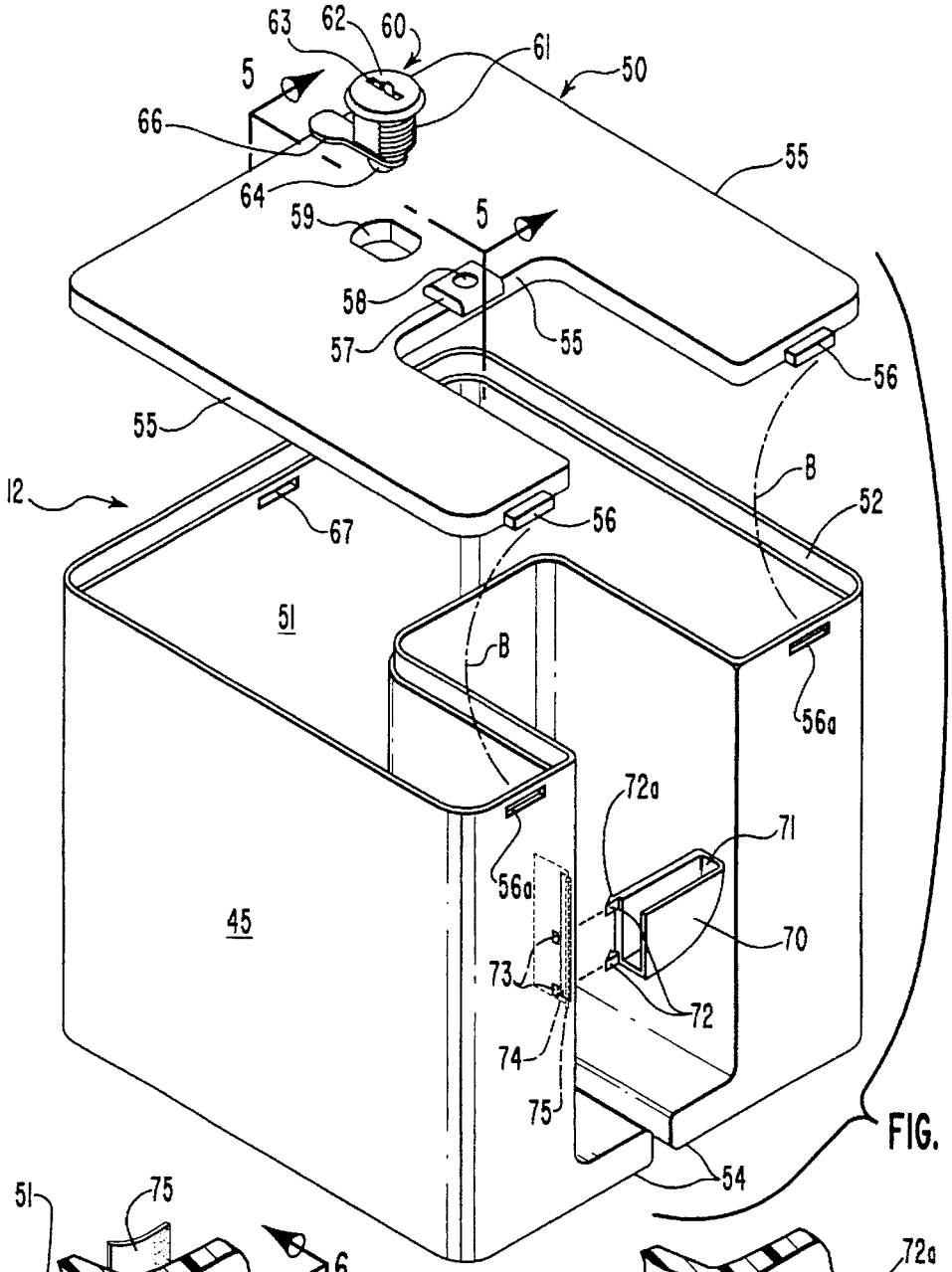
FIG. 2 is an exploded perspective view of the body of the coin box vending machine of FIG. 1 shown containing the liner, and showing the coin box locking plate exploded therefrom.

The above set out description of the vending machine head portion 11 should be taken as describing a head portion of a number or currently marketed vending machines. Such a machine is manufactured by Oak Manufacturing Co. Inc. and is known as a Vista Machine, and an earlier U.S. Pat. No. 5,131,519 of the inventor shows such a machine. The hopper or head portion 11 and components of the body 12, to include the coin mechanism 32, the chute 35 that is open therethrough and has an open product receiving end 35*a* and an open product dispensing end 35*b*, the chute cover 36, a body housing 45 and a base 46, as shown in FIGS. 1 and 2, and their functioning, it should be understood, are not unique to the invention. These structures are very much like the Vista Machine, and the vending machine of my earlier U.S. Patent, cited above. It should, however, be understood, that the present invention is suitable for inclusion with the Vista Machine and the vending machine of my earlier U.S. Patent, as cited above, and like machines, as and addition and improvement thereto. Accordingly, references to the Vista Machine, and the vending machines of my earlier U.S. Patent, cited above, are included by way of examples only of vending machines as are suitable for incorporating the present invention.

The body 12, shown in FIG. 1, includes the body housing 45, that is shown as having essentially a rectangular shape and wherethrough the center rod 37, extends, at a right angle, upwardly from a sleeve 47 that is secured to the center of a base 46. The center rod 37, as set out above, is for joining the body portion 12 and head portion 11 together, as the vending machine 10.

Additional to the above set out components of the body portion 12, that are common to earlier vending machines, including the vending machine of the above set out U.S. Patent, the present invention includes a cover 48 that is for mounting across a top portion of the chute 35. The chute 35, at a mid step section, includes opposing rounded slots 49*a* that are formed in stepped edges of opposite chute sides. The rounded slots 49*a* are to receive cylindrical pin ends 49*b* that extend outwardly from the top end of the chute cover 36. So arranged, a lower portion of the plate 48 closes the open top ends of the rounded slots 49*a* to contain the pin ends 49*b* as a pivot mounting of the chute cover 36 positioned over the chute dispensing end 35*b*.

FIGS. 1 and 2 show a locking plate 50 that is aligned for fitting over an open top end of the body housing 45. Which body housing 45 receives coins passed through the coin mechanism 32. The locking plate 50 is to close over and is locked in place, as set out below, to prohibit coins from passing out from the body housing, even should the body housing 45 be turned over and shaken. While the cited U.S. Patent of the inventor includes a cover that is also shown as a plate with a locking arrangement for closing over a coin containing section, the locking plate 50 provides also for a sealing to a top lip 52 of a liner 51 of the invention, as described below.

Figure 3:
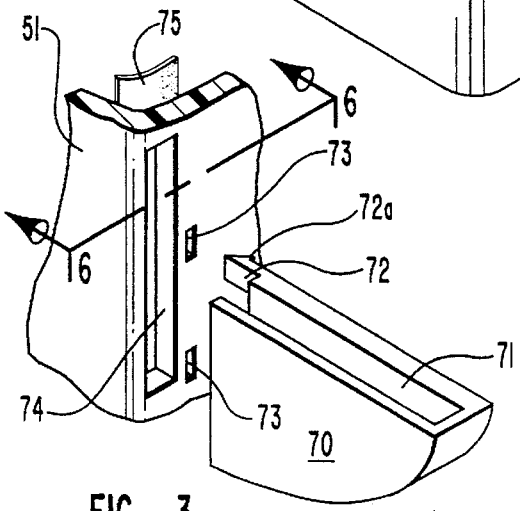
FIG. 3 is an expanded view of a coin guide of FIGS. 1 and 2, aligned for fitting tab ends thereof into recessed that have been formed in a section of the vending machine body, showing a guide discharge end positioned over a straight vertical slot that is formed through the body and communicates with a slot opening formed through the liner whereover a section of liner material is arranged as a flap.
Figure 4:
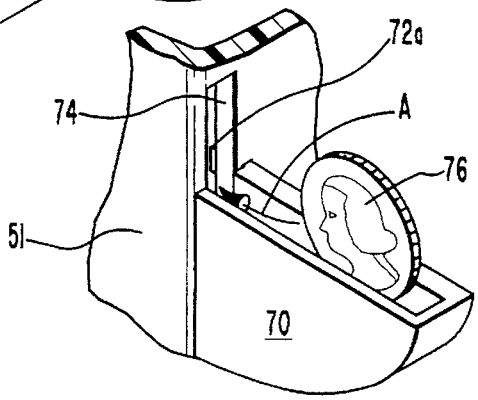
FIG. 4 is a view like that of FIG. 3 only showing the coin guide connected to the vending machine body and showing a captured quarter traveling, shown by arrow A, towards the body slot to pass into the body.

Shown in FIGS. 1 and 2, the body housing 45 is arranged to fit onto the base 46, with the center rod 37 extending at a right or normal angle upwardly from the base 46 collar 47. The body housing 45 is slotted in one wall, from a top edge to above the bottom thereof, for accommodating, at the slot bottom, a dispensing chute 35. The dispensing chute 35, in turn, includes the describe pivoting chute cover 36 pivotally mounted across the chute dispensing end 35*b* to swing upwardly from a covering attitude over that dispensing chute end. A conventional coin mechanism 32 is fitted between a pair of opposing housing slots 35*c* that are formed in the housing, adjacent to and at right angles to the chute top end 35*a*. So arranged, the coin mechanism 32 opposite edges interdigitate with the slot edges, maintaining the coin mechanism therein, with a bottom edge of the coin mechanism to engage a top of the chute cover 48, covering the chute cover pivot mountings. Within the second line 80 embodiment set out hereinbelow, edges of a liner opening 81 engage, to closely fit against surfaces of a side of coin mechanism 32. The liner 51 of FIGS. 1 and 2, as shown, and liner 80 of FIGS. 7 through 9, described below, are formed to fit snugly within the body housing 45, and may be formed with or to include a separate bottom plate or section 53 that a liner bottom edge 54 engages and seals against. The liners 51 and 80 are each preferably formed of a plastic material, as illustrated in FIGS. 3 and 4, to have approximately the inside dimensions of the body housing 45 to, as shown best in FIGS. 1 and 9, fit snugly, and, once installed, are each maintained therein as with an application of an adhesive between the liner outer surface and the body portion interior, securing the liners 51 and 80 therein. Accordingly, the liners 51 and 80 are preferably bonded to the body housing 45 wall, with the bottom plate or section 53 urged into sealing engagement with the liner lower edges 54 or 82 by the top surface of the base 46. Thereafter, and with the cover plate 50 for liner 51 and a cover plate 90 for liner 80 are secured to, to essentially seal to the liner top lips 52 or 83, to contain any coins within the body housing, functioning as a coin safe or box of the invention. Heretofore, coins may have been lost from a coin vending machine body portion like that of the afore set out U.S. Pat. No. 5,131,519 of the inventor, if the body housing was turned over, shaken, or the like, causing coins to pass through cracks between the housing body and coin mechanism, locking cover, and the like. By an installation of the liners 51 or 80 of the invention, mounted between the bottom plate or section 53 and cover plates 50 or 90, a closed secure container is provided that coins cannot be shaken from.

Figure 5:
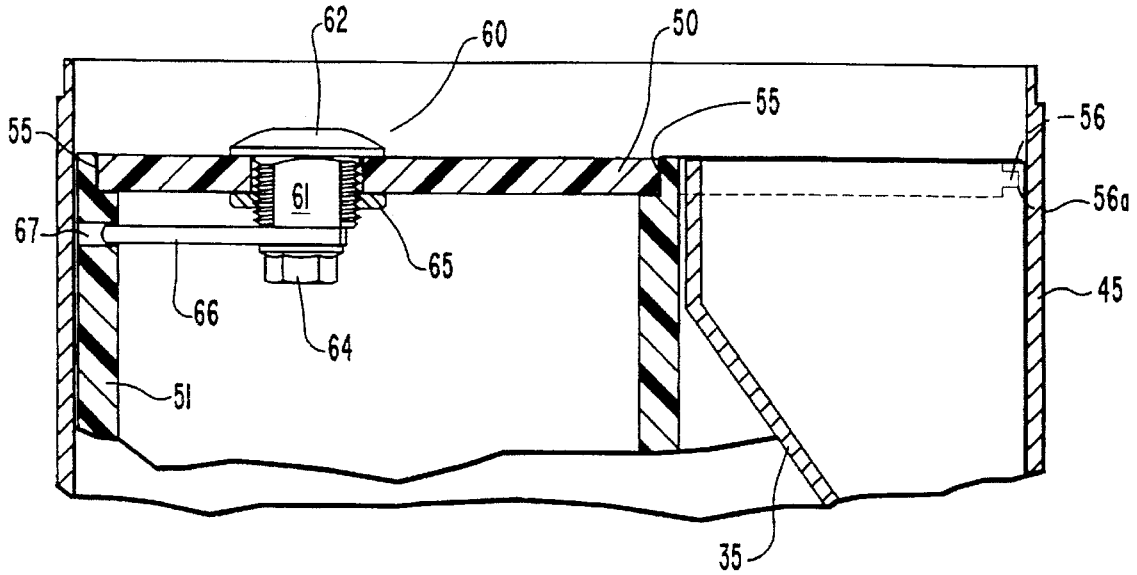
FIG. 5 shows an enlarged sectional view taken along the line 5—5 of FIG. 1 showing a bar lock of the locking plate turned into slot that has been formed through the liner, locking the locking plate over the liner open top.
Figure 7:
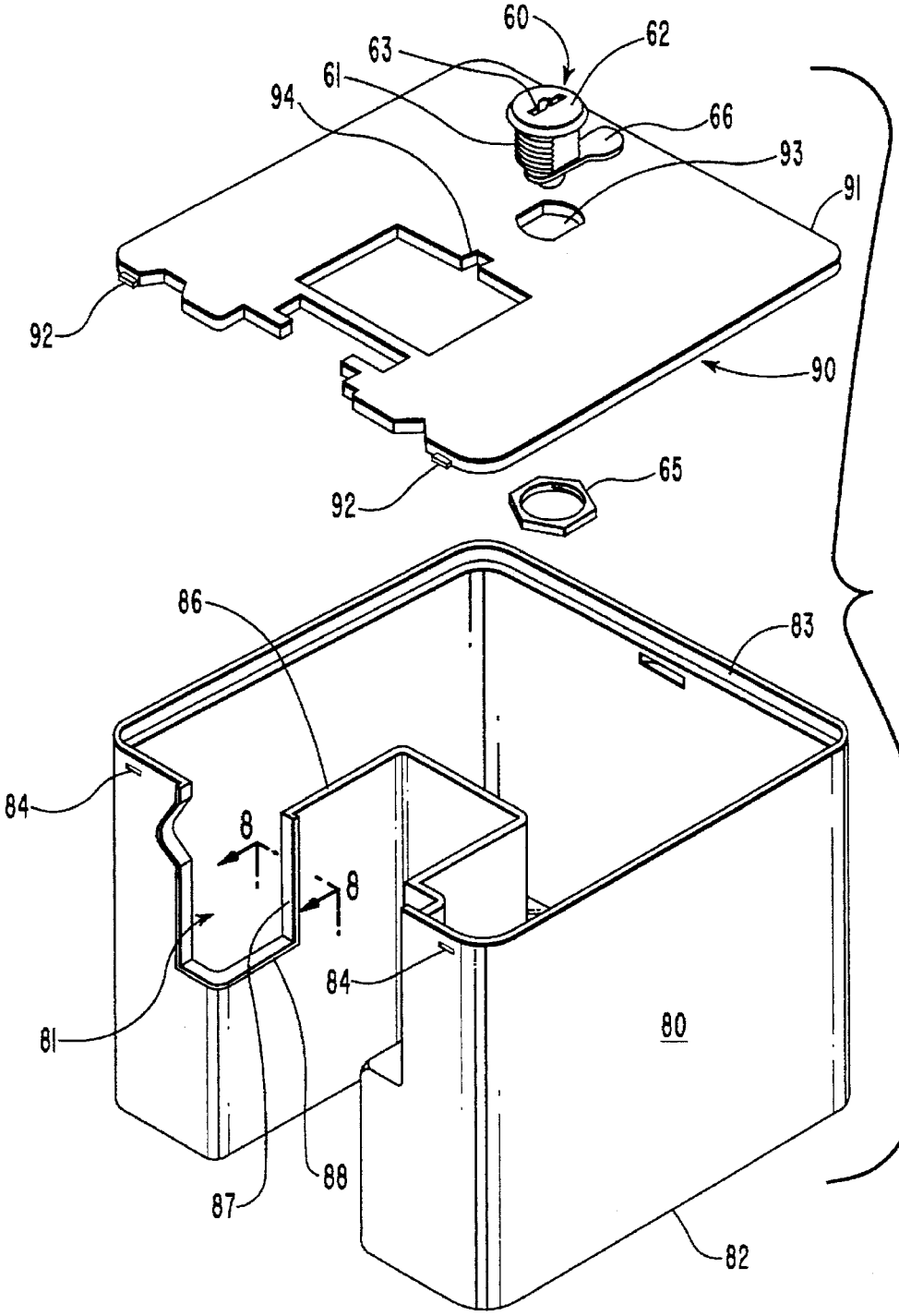
FIG. 7 is a profile perspective exploded view of another embodiment of a liner showing a locking plate with a lock that includes a movable bar lock aligned with an opening formed through the locking plate.
Figure 9:
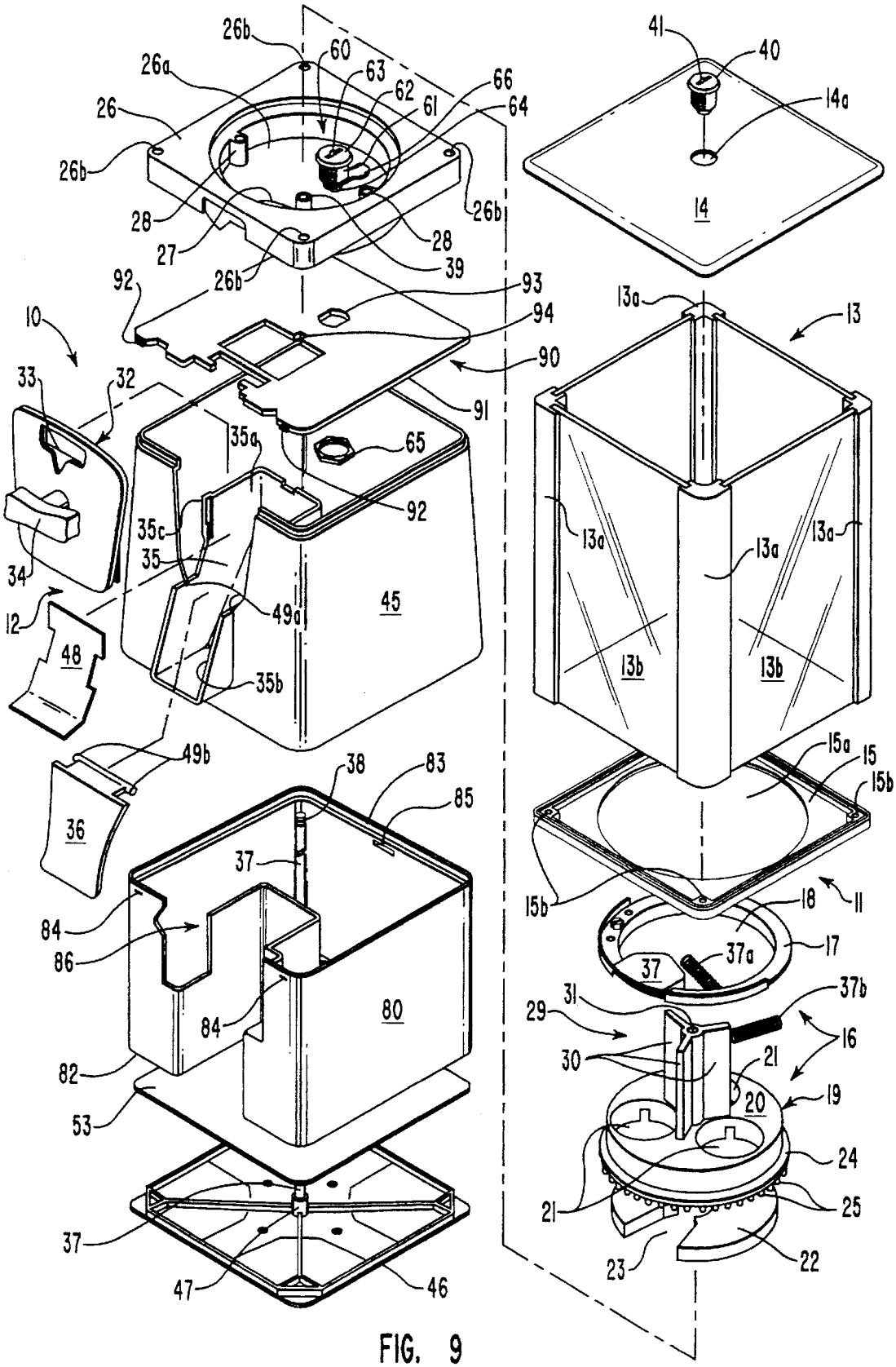
FIG. 9 is a view like that of FIG. 1 only showing the liner of FIG. 7.

To provide for securing the locking plate 50 onto the liner top lips 52 or 83, as shown best in FIG. 2, in FIG. 5, and in FIGS. 7 and 9, has the right angle step 52 or 83 formed therein, the flat cover plate 50 edge 55 fits within. So arranged, the cover plate 50 edge 55 and edge 91 of cover plate 90 will seat and seal in the right angle step 52 or 83. To provide for securing the locking plates to the liner, the locking plates 50 and 90, along a forward edge of each between a U-shaped recess, includes for locking plate 50, a pair of outwardly extending tabs 56 with locking plate 90 having outwardly extending tabs 92, that are for fitting into slots 56*a* of liner 51 and slots 84 of liner 80 that are extended into the body housing 45. Which slots 56*a* and 84 are proximate to the liner top edge, with the locking plates 50 or 80 closed thereover, shown in broken arcs identified by curved broken line B in FIG. 2. A lock 60, shown in FIGS. 1, 2, 7 and 9, is provided for mounting in a hole 59 that has been formed through the locking plate 50, and in a hole 93 formed through locking plate 80, respectively. The holes 59 and 92 are each adjacent to and spaced rearwardly from a center pier 57 that has a hole 58 for liner 50 and hole 94 for liner 80 wherethrough the center rod 37 is fitted. The lock 60, as shown in FIGS. 1, 2, 5, 7 and 9 preferably includes a threaded barrel housing 61 that is shaped to fit through hole 59 or 93 and is threaded to receive a nut 65 turned thereon, as shown in FIGS. 5 and 7. The nut 65 is turned onto the threaded barrel housing, to rest against the undersurface of the locking plate 50 or 90. Turning of nut 65 pulls an undersurface of a broad head 62 of the lock 60 against the edge of hole 59 or 93, thereby securely mounting the lock 60 in the locking plate 50 or 90. The lock 60 barrel housing maintains a center cylinder that incorporates, in its upper end, a keyway 63, shown in FIGS. 1, 2, 7 and 9, and includes a threaded axial opening formed into its bottom end. The keyway 63 is to receive a key, not shown, fitted therein for turning the center cylinder, and the threaded axial opening is to receive a bolt 64, shown in FIG. 5, after it has passed through a hole formed in an end of a flat bar 66. An opposite end of bar 66 is for fitting into a slot 67 that has been formed in the liner 51 or slot 85 formed in liner 80. So arranged, turning a key in keyway 63 turns the lock center cylinder to, in turn, move the bar 66 end, that is shown as preferably rounded, into and out of the slot 67 or 85. Thereby, with the locking plate tabs 56 or 92 fitted into the slots **56*a* or 84, and with the locking plate 50 or 90 lowered onto the fight angle lip 52 of liner 51, or lip 83 of liner 80, and the lock 60 operated to pivot the bar 66 rounded end into the slot 67 or 85, the locking plate 50 or 80 is locked over the open top end of liner 51 or 80**.

Figure 6A:
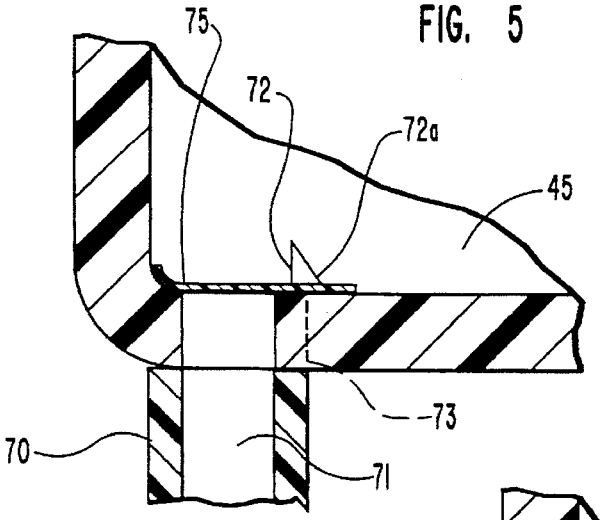
FIG. 6A is a sectional view taken along the line 6—6 of FIG. 3, showing a flap formed of the liner, material fitting over the slot.
Figure 6B:
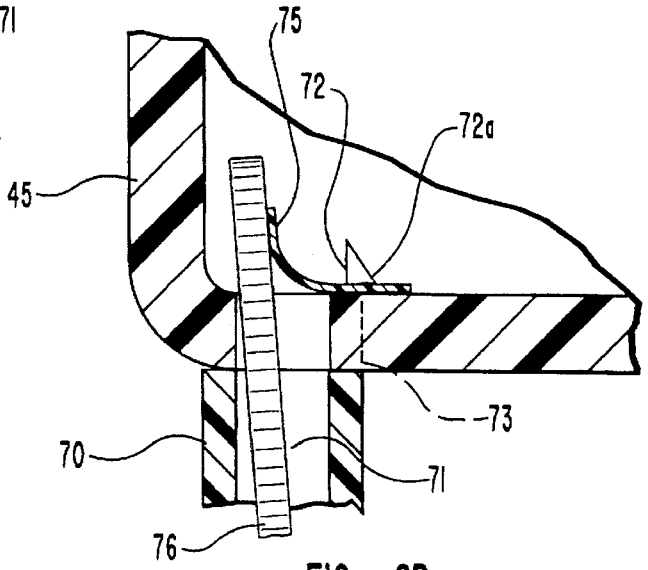
FIG. 6B is a view like FIG. 6A showing a coin passing through the slot to open the flap.

As set out above, a closed as the lock safe or nut container is provided by the liner 51 or 80 with the locking plate 50 or 90 installed across the liner 51 lip 52 or the liner 80 lip 83. For utilizing the closed liner 51 or 80 to function as a coin safe or box, it is, of course, necessary to provide for passage of coins that have traveled through the coin mechanism 32 and into the liner 51 or 80. To provide for which coin travel for liner 51, as shown in FIGS. 1 through 4, and 6A and 6B, a right angle coin guide 70 is included. The coin guide 70, as shown, preferably includes a narrow rectangular top opening 71 for positioning below a coin discharge port, of the coin mechanism 32, not shown. Which coin guide positioning is maintained by fitting hook ends **72*a* of parallel fingers 72 that extend from a flat discharge end of the coin guide into slots 73 that have been formed through the liner 51, alongside a slot 74 formed therethrough. The hook ends 72*a* are to flex over a rear edge of slot 74, as shown in FIG. 4, locking the coin guide to the liner, as shown in FIG. 4. Thereby, when a coin, shown in FIGS. 4 and 6B as a quarter 76, is fitted in the coin mechanism to enable turning of the handle 34, and with handle turned, that coin will pass through the coin mechanism and fall into the coin guide opening 71, as shown in FIG. 4. Once therein, the coin rolls down the coin guide, shown as arrow A, and is directed into slot 74 that has been formed through the liner 51. In which travel, the coin travels past a flap 75 that is arranged across the slot 74. The flap 75, as shown in FIG. 6A, is secured along a vertical edge to the liner to pivot across the slot 74. The flap 75, as shown in FIG. 6B, is pushed open by passage of the coin 76 therethrough. So arranged, the flap 75 functions as a valve, allowing passage of a coin into the liner, but, will then pivot back over the slot 74, prohibiting coins from passing back therethrough. Coins that have passed into the liner 51 are prohibited from being removed by other than a person having a key for operating the lock 60, with the closed liner 51** functioning as a lock safe or box.

Figure 8:
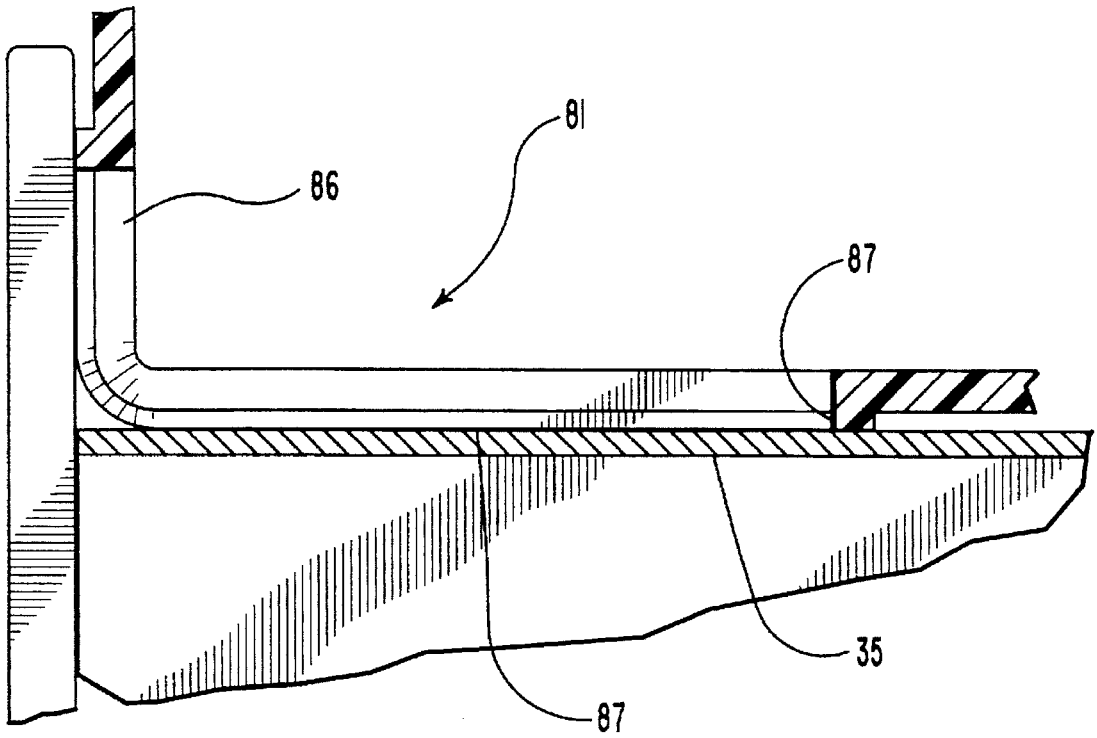
FIG. 8 is an enlarged sectional view taken along a liner edge that engages to closely fit against the side of a coin operated vending mechanism.

To provide for coin passage from the coin mechanism 32 into liner 80, as shown in FIGS. 7 through 9, an edge 86 around the opening 81 into the left side of liner 80 is bent slightly outwardly at 87, as shown in FIG. 8, and a forward face 88 is flattened thereacross. The bend 87 provides for some flexure allow the edge to flex and fit tightly against the coin mechanism surface 35, shown as a metal section in FIG. 8, urging the flat forward face 88 thereagainst. So arranged, coins pass freely from the coin mechanism 32 through the opening 81 to fall into the liner 80. The close fitting engagement of the liner edge 86 flexed at bend 87, urges the flat face 88 thereof against the left side of coin mechanism 32. This precludes outward passage of coins from within the liner 80, even if the liner is shaken, a narrow blade is fitted between the coin mechanism and liner edge 86, or the like, securing the coins within the liner, as described.

As set out above, the vending machine 10 head portion 11 is easily separated from the body housing 12, allowing for filling that head portion with product and replacement onto the body housing 12. In practice, with the locking plates 50 or 90 installed, as described, an operator can remove a coin filled body housing 12 for later opening by a key operator, and replace that body with an empty body. So arranged, access to the coin containing liners 51, 80 that are each maintained within the body housing 12 is provided to persons only who have a key to unlock the lock 60, minimizing a potential for unauthorized coin removal.

While a preferred arrangement of a vending machine with different liner embodiments and locking plate mountings of the present invention have been shown and described herein, it should be understood that the present disclosure is made by way of example only, and that changes and modifications can be made thereto without departing from the subject matter coming within the scope of the following claims and a reasonable equivalency thereof, which claims I regard as my invention.

I claim:

1. A coin vending machine liner and locking plate as a coin safe comprising, for a coin operated vending machine, a base that mounts across a bottom end of a body whereon a hopper for containing products to be vended is positioned, and including a means for securing said base, body and hopper together; a liner that is closed across its base and is formed to conform to and is to be maintained within said vending machine body; a locking plate for fitting over an open top end of said liner, and including a key operated lock means for mounting in said locking plate to pivot a pivoting bar means into and out of alignment with a slot that is formed in said liner, below a rear top edge thereof, and at least one tab means, that extends from a locking plate forward edge, for fitting into a slot that has been formed in said liner, below a forward top edge thereof, and a security means included with said liner for directing coins from a vending machine coin mechanism into said liner and seals against coins passing out of said liner to travel alongside said vending machine coin mechanism.

2. A coin vending machine liner and locking plate as a coin safe as recited in claim 1, wherein the locking plate is a flat plate having dimensions to fit onto a step that is formed around a top edge of the liner; and the key operated lock means is secured in an opening in the locking plate that is adjacent to said lock plate rear edge and includes a center cylinder that is turned by a key, and said center cylinder connects to a narrow straight flat bar as the pivoting bar means that has an outer end formed to turn into a slot that is formed into a rear wall of said liner, below the step that is formed around the liner edge.

3. A coin vending machine liner and locking plate as a coin safe as recited in claim 1, wherein the liner is formed from a plastic material to conform to and to be maintained within the body and is open at both top and bottom ends; and including a separate bottom plate, that is a flat section of material arranged to fit snugly within said body, to rest on a base of said body, with liner bottom end seated thereon.

4. A coin vending machine liner and locking plate for a coin safe as recited in claim 1, wherein the security means consists of a guide means for directing coins passed from a coin mechanism of said coin operated vending machine into said liner that includes a passage way that directs a coin received in a receiving end of said guide mans from a vending machine coin mechanism, into a vertical slot formed into said liner; and means arranged to extend across said vertical slot to allow passage of a coin traveling from said guide means, and to block coin passage back out of said slot.

5. A coin vending machine liner and locking plate as a coin safe as recited in claim 4, further including, the guide means is a narrow tubular section that is open, has a width and height to accommodate passage of the coin therethrough and is curved through approximately ninety (90) degrees; and means for connecting a dispensing end of said guide means end to the liner, so as to align said dispensing end to the vertical slot in said liner.

6. A coin vending machine liner and locking plate as a coin safe as recited in claim 5, wherein the means for connecting is at least one arm that extends from the guide means dispensing end that includes a hook end; and at least one hole formed in the liner, alongside of the vertical slot to receive said arm hook end fitted therein, with said hook end formed to limit withdrawal of said arm out from said liner hole.

7. A coin vending machine liner and locking plate for a coin safe as recited in claim 4, wherein the means that extends across the vertical slot is a flap formed of a flexible material that is connected along an edge to the liner to extend across said liner vertical slot and to pivot from covering arrangement of said vertical slot to allow for passage of the coin from the guide means and will return to covering alignment over said liner vertical slot after said coin has passed into said liner, blocking coins from passing out from within said liner through said vertical slot.

8. A coin vending machine liner and locking plate for a coin safe as recited in claim 1, wherein the security means is an edge of an opening formed through the liner that is adjacent to a wall of the vending machine coin mechanism wherefrom coins are passed, which said liner edge is bent slightly outwardly from the plane of said liner, to provide a liner edge face to engage and fit snugly against the surface of said wall of said vending machine coin mechanism.

9. A coin vending machine liner and locking plate for a coin safe as recited in claim 8, wherein the liner edge face is formed to have a flat surface for fitting snugly against the surface of the wall of the vending machine coin mechanism.

* * * * *